US009617764B2

(12) United States Patent
Vasi et al.

(10) Patent No.: US 9,617,764 B2
(45) Date of Patent: Apr. 11, 2017

(54) HIDDEN FLUSH OUTSIDE HANDLE

(71) Applicant: AISIN TECHNICAL CENTER OF AMERICA, INC., Plymouth, MI (US)

(72) Inventors: Stephanie Vasi, Troy, MI (US); Eric Archambeau, Canton, MI (US); Mike Howlett, Troy, MI (US)

(73) Assignee: AISIN TECHNICAL CENTER OF AMERICA, INC., Plymouth, MI (US)

( * ) Notice: Subject to any disclaimer, the term of this patent is extended or adjusted under 35 U.S.C. 154(b) by 182 days.

(21) Appl. No.: 14/182,763

(22) Filed: Feb. 18, 2014

(65) Prior Publication Data

US 2014/0300115 A1 Oct. 9, 2014

Related U.S. Application Data

(60) Provisional application No. 61/808,067, filed on Apr. 3, 2013.

(51) Int. Cl.
*E05B 3/00* (2006.01)
*E05B 85/10* (2014.01)

(52) U.S. Cl.
CPC ..... *E05B 85/103* (2013.01); *Y10S 292/31* (2013.01); *Y10T 292/57* (2015.04)

(58) Field of Classification Search
CPC ..... Y10T 292/57; Y10S 292/31; E05B 77/42; E05B 85/103
USPC ..... 292/336.3, DIG. 31
See application file for complete search history.

(56) References Cited

U.S. PATENT DOCUMENTS

| | | | | |
|---|---|---|---|---|
| 4,588,219 | A | 5/1986 | Kobayashi et al. | |
| 5,560,659 | A * | 10/1996 | Dault | E05B 13/005 292/336.3 |
| 6,062,614 | A * | 5/2000 | Petzold | E05B 85/14 292/336.3 |
| 7,108,301 | B2 * | 9/2006 | Louvel | E05B 81/78 292/201 |
| 7,343,646 | B2 * | 3/2008 | Hayashi | E05B 85/18 16/412 |
| 8,109,545 | B2 * | 2/2012 | Lukas | E05B 13/002 292/336.3 |
| 2015/0013403 | A1 * | 1/2015 | Fujiwara | E05B 81/78 70/263 |

(Continued)

FOREIGN PATENT DOCUMENTS

| | | | | |
|---|---|---|---|---|
| DE | 3818187 C1 * | 8/1989 | ..... | E05B 85/14 |
| DE | 19608181 A1 * | 9/1997 | ..... | E05B 85/18 |

(Continued)

OTHER PUBLICATIONS

U.S. Appl. No. 14/267,490, filed May 1, 2014, Vasi, et al.

*Primary Examiner* — Kristina Fulton
*Assistant Examiner* — Christine M Mills
(74) *Attorney, Agent, or Firm* — Oblon, McClelland, Maier & Neustadt, L.L.P.

(57) ABSTRACT

An outside handle of a vehicle that releases a door latch, including a slot that includes a rotatable flap that sits flush against an outer panel of the vehicle in a closed position. The rotation of the flap provides an opening to an inside of the handle in an open position. The handle includes a rotating lever behind the outer panel, and a lock rod attached to the rotating lever. Downward rotation of the lever moves the rod downward, and the downward motion of the rod then triggers the latch.

7 Claims, 5 Drawing Sheets

(56) References Cited

U.S. PATENT DOCUMENTS

2015/0315812 A1* 11/2015 Vasi ..... E05B 5/006
292/336.3

FOREIGN PATENT DOCUMENTS

| | | | | | |
|---|---|---|---|---|---|
| DE | 19847212 | A1 * | 4/2000 | ..... | E05B 85/14 |
| EP | 0194725 | B1 * | 4/1988 | ..... | E05B 85/18 |
| JP | 59102765 | U * | 7/1984 | | |

* cited by examiner

HIDDEN FLUSH OUTSIDE HANDLE

BACKGROUND OF THE INVENTION

Field of the Invention

Exemplary aspects of the present invention relate to a hidden, flush mounted outside handle for opening a door of a vehicle.

SUMMARY OF THE INVENTION

The present application relates to a door handle of a vehicle with a flush and aerodynamic appearance by placing the mechanical pieces behind an outer panel and keeping them hidden. The functionality of the handle is not compromised, and a user is able to grip the handle in a similar motion to the current outside handle design.

An outside handle of a vehicle that releases a door latch, includes a slot that includes a rotatable flap that sits flush against an outer panel of the vehicle in a closed position. The rotation of the flap provides an opening to an inside of the handle in an open position. The handle includes a rotating lever behind the outer panel, and a lock rod attached to the rotating lever. Downward rotation of the lever moves the rod downward, and the downward motion of the rod then triggers the latch.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DETAILED DESCRIPTION OF THE PREFERRED EMBODIMENTS

Figure 1:
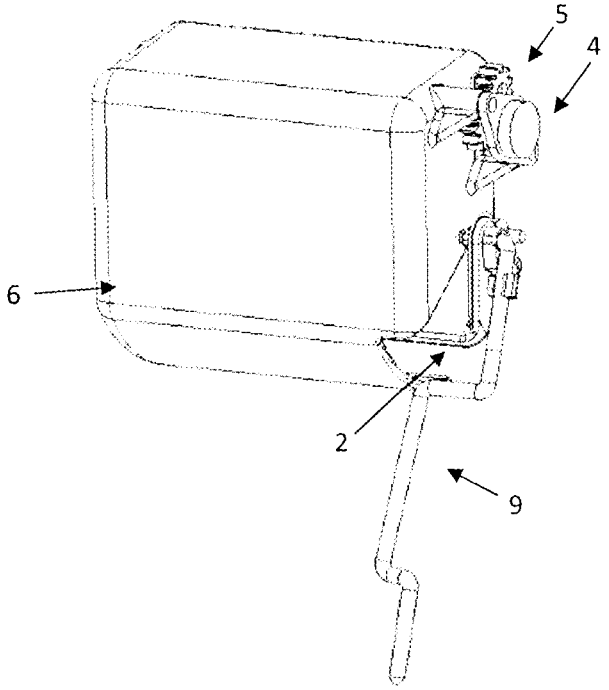
FIG. 1 illustrates an isometric view of a hidden handle assembly in the closed position in accordance with the present disclosure.

Referring now to the drawings, wherein like reference numerals designate identical or corresponding parts throughout the several views. Further, as used herein, the words "a," "an" and the like generally carry a meaning of "one or more," unless stated otherwise.

FIGS. 1-5 depict various aspects of a hidden door handle for a vehicle. Here a vehicle refers to a land vehicle exemplified by an automobile. However, the present disclosure is also applicable to any similar type vehicle, such as but not limited to, a sport utility vehicle, a pickup truck, a commercial vehicle, aircraft, boat, or the like.

Figure 2:
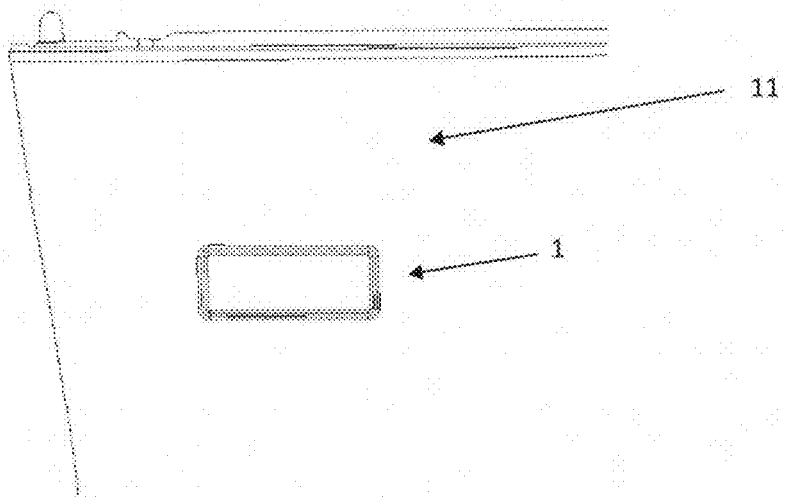
FIG. 2 illustrates a front view of a hidden handle assembly in the closed position, attached to the door panel from the exterior of the vehicle in accordance with the present disclosure.
Figure 5:
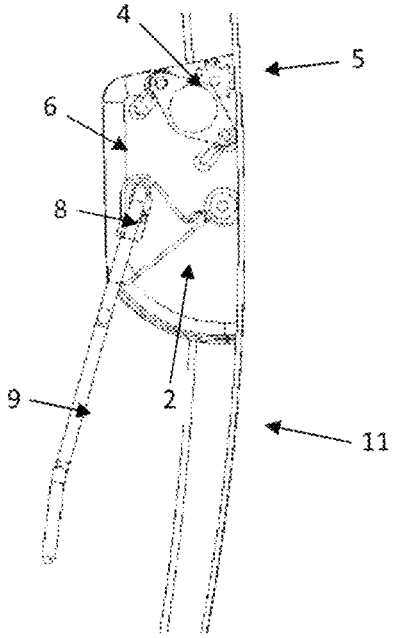
FIG. 5 illustrates a side view of a hidden handle assembly in a closed position, attached to an outer door panel in accordance with the present disclosure.

FIG. 1 displays an isometric bottom view of a hidden door handle assembly. FIG. 5 illustrates a side view of this assembly. FIG. 2 illustrates a top flap 1 disposed in an outer door panel 11. The flap 1 has a generally rectangular shape, but is not limited to such a shape.

Behind the top flap 1 is an interior space defined partially by the flap and a case 6. Shown in FIG. 5, the case 6 has a back surface opposite to the flap 1. As shown in the figures, the case 6 encloses the operational parts of the handle assembly. Aside from aiding in mounting and supporting the components, the case 6 aids the user to feel more comfortable inserting his or her hand inside the door.

Attached to the case is a rod 10 which extends between side surfaces of the case 6. The rod 10 traverses a width of the case 6 and is located at the top of the case 6. The rod 10 is attached to the flap 1, so that the flap 1 is rotatable about the rod 10. The rod 10 defines an axis of rotation for the flap 1. When pushed from the outside, the top flap 1 rotates around the rod 10, causing the flap 1 to enter the interior space of the case 6.

A pivot 7 is attached to a lever 2. The pivot 7 is located at a middle portion of the side surfaces of the case 6. The pivot 7 defines an axis of rotation for the lever 2. That is, the lever 2 is rotatable about the pivot 7. The pivot 7 is illustrated as interfacing with the case 6 on one side but a second pivot (not illustrated) may also be provided to the opposite side of the case 6.

Shown in FIG. 1, the lever 2 has two portions. A first portion of the lever 2 is generally rectangular and is pivotable around the pivot 7. The second portion of the lever 2 is generally triangular and extends from an end of the first portion. The second portion is formed at an angle relative to the first portion. The angle being approximately 90 degrees in the figures. A lock rod 9 is attached to the lever 2 at the second portion. The lock rod 9 is attached to a latching mechanism or latch of the door (not illustrated), and sufficient movement of the lock rod 9 opens the latching mechanism, thereby allowing the door to be opened. The lock rod 9 is attached to the lever 2 by a rod clip 8 and is able to rotate freely.

FIG. 2 illustrates an exterior view of the assembly including the flap 1 in a closed position. Here, an outer surface of the flap 1 sits flush with the outer door panel 11. The top flap 1 is the only part of the handle that is seen from the exterior and fits properly into a slot made in the outer panel 11 of the door. This is what creates the flush appearance to the exterior of the vehicle.

Figure 3:
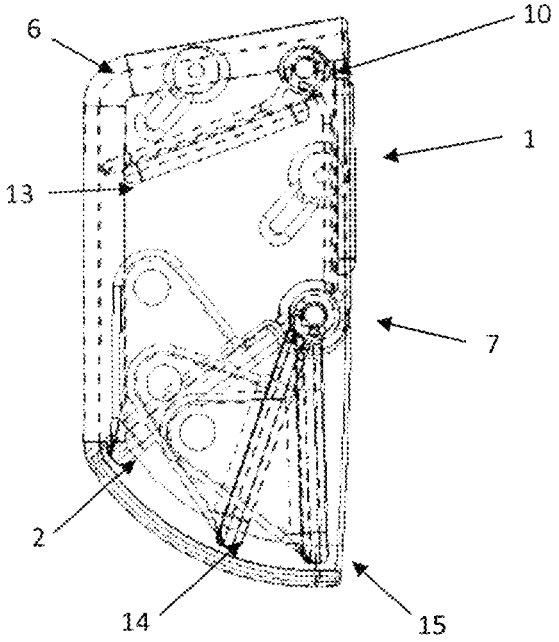
FIG. 3 illustrates a side view of a hidden handle assembly in different positions of the motion in accordance with the present disclosure.

FIG. 3 illustrates different positions and motions of the top flap 1 and the lever 2 during operation. FIG. 3 illustrates three positions of the lever 2. The topmost position of the lever 2 is a rest or beginning position. When the lever 2 is rotated 34 degrees (at point 14), the lock rod 9 is moved a sufficient amount so that the latch is triggered. At point 15, the lever 2 is at a position in which the user has fully clamped the handle and where the lever 2 would touch the outer panel 11 of the door. FIG. 3 also illustrates the top flap 1 in two positions. The first is rightmost in FIG. 3, and corresponds to the flap 1 being in the closed position. The second is position 13 which corresponds to the flap 1 being in the open position. The open position 13 of the top flap 1 allows room for a 95 percentile hand to fit inside the interior space of the case 6.

Described above, the top flap 1 and the lever 2 each pivot on a rod 10 and pivot 7, respectively. Springs are provided to bias the flap 1 and the lever 2 back toward their initial positions, respectively, as shown in FIG. 5. To prevent the user's hand from getting caught inside the handle, the closing speed of the flap 1 is controlled by a one way damper 4. The one way damper 4 is mounted to the case 6 and meshes with a gear 5 that is mounted on the pivoting rod 10. The one way damper 4 is allowed to move freely in a first direction (e.g. clockwise) and adds resistance in a second direction (e.g. counter clockwise). Accordingly, the top flap 1 closes slowly. If needed, a spring (not illustrated) may be mounted outside of the case 6 and rest on the portion of the lever 2 that sticks out past the case 6 and the inside of the outer door panel 11. This spring biases the lever 2 towards the topmost, rest position as shown in FIGS. 3 and 5.

Figure 4:
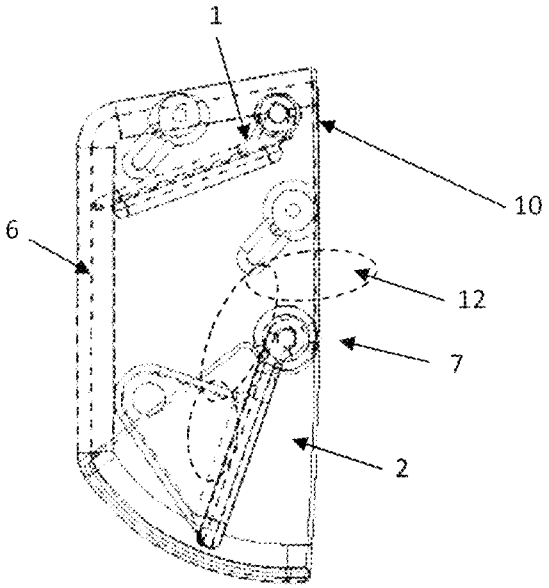
FIG. 4 illustrates a side view of a hidden handle assembly in the open position being functioned by a user in accordance with the present disclosure.

FIG. 4 schematically illustrates a user's hand 12 inside the handle. Here, the flap 1 is in the open position (13 in FIG. 3) and the hand 12 is operating the lever 2 to trigger the latch. The position of the lever 2 in FIG. 4 is similar to position 14 illustrated in FIG. 3, which will cause the lock rod 9 to open the latching mechanism. FIG. 4 illustrates the first two parts of the user's fingers on the user's hand 12 operating the handle, which is a common gripping motion.

Described above, the hidden handle assembly of the present application has several advantages. The first being a sleek and aerodynamic appearance from the outside of the vehicle. Further, the handle operates in a similar pulling motion that is customary with typical door handles. Therefore, the user gets the benefit of the exterior appearance and customary motion. Moreover, safety is considered by damping the motion of the top flap so as to not pinch a user's hand.

Obviously, numerous modifications and variations of the present invention are possible in light of the above teachings. It is therefore to be understood that within the scope of the appended claims, the invention may be practiced otherwise than as specifically described herein.

The invention claimed is:

1. An outside handle of a vehicle that opens a latch, comprising:

a slot that includes a rotatable flap that sits flush against an outer panel of the vehicle in a closed position and that provides an opening to an interior of the handle in an open position;

a lever including a first end and a second end, the lever rotating around an axis at the first end that is adjacent to the outer panel and that is below the opening;

a case that surrounds the flap and the lever, the case including a curved bottom portion; and a rod attached to the lever, wherein downward rotation of the lever moves the rod downward and the downward motion of the rod triggers the latch, a complete range of rotation of the lever is within the interior defined by the case and the outer panel, and the curved bottom portion of the case corresponds to the second end of the lever distal from the axis throughout the complete range of rotation of the lever.

2. The outside handle of claim 1, wherein the flap includes a damper that slows a closing motion of the flap from the open position to the closed position.

3. The outside handle of claim 1, wherein once the handle is released the flap returns to the closed position and the lever and the rod return to an original position.

4. The outside handle of claim 1, wherein the axis of rotation of the lever is substantially centered in the case in a vertical direction of the case.

5. The outside handle of claim 1, wherein the lever includes a surface that faces an interior surface of the outer panel when the lever is moved in a fully downward position.

6. The outside handle of claim 1, wherein a distance between the second end of the lever and the curved bottom portion of the case is substantially constant throughout the complete range of rotation of the lever.

7. The outside handle of claim 1, wherein the curved bottom portion extends between the outer panel and a back surface of the case that is substantially parallel to the outer panel.

* * * * *